US005683122A

United States Patent [19]

Lee

[11] Patent Number: 5,683,122

[45] Date of Patent: Nov. 4, 1997

[54] LOCKING DEVICE FOR MANHOLE INNER COVERS

[76] Inventor: Eui-Keun Lee, #105-106 Woosung Bestopia Apartment, 500-1 Pokchun-dong, Tongrae-ku, Pusan, Rep. of Korea

[21] Appl. No.: 694,672

[22] Filed: Aug. 9, 1996

[51] Int. Cl.[6] ..... F05C 1/12

[52] U.S. Cl. ..... 292/39; 292/172; 70/168; 404/25

[58] Field of Search ..... 292/39, 172, 142, 292/256.5, DIG. 11; 70/163, 166, 167, 168, 169, 170, 171, 172, 173; 404/25

[56] References Cited

U.S. PATENT DOCUMENTS 1,065,358 6/1913 Hanson ..... 70/168

5,082,392 1/1992 Marchese et al. ..... 70/168 X

FOREIGN PATENT DOCUMENTS 23642 of 1912 United Kingdom ..... 292/39

*Primary Examiner*—Rodney M. Lindsey

*Attorney, Agent, or Firm*—Michael N. Meller

[57] ABSTRACT

A locking device for manhole inner covers is disclosed. The locking device is operated only by an authorized key thus almost completely protecting the underground arrangements such as pipes, drains or wires from unauthorized persons, who intend to reach the arrangements with the object of damaging or breaking the arrangements. The locking device is cased by a longitudinal channel type housing. Two reciprocating units are arranged in the housing so that the arrangement of the units inside the housing is point-symmetric about the center of the housing. Each unit has a plurality of regularly-spaced gear holes, which selectively engage with the asterisk part of a key. A locking bolt is coupled to each reciprocating unit and fully projects or retracts from or into the housing. A keyhole panel is movably seated on a central member so that the keyhole panel can move in a vertical direction. The keyhole panel has an asterisk keyhole.

1 Claim, 7 Drawing Sheets

Fig. 9 (a)
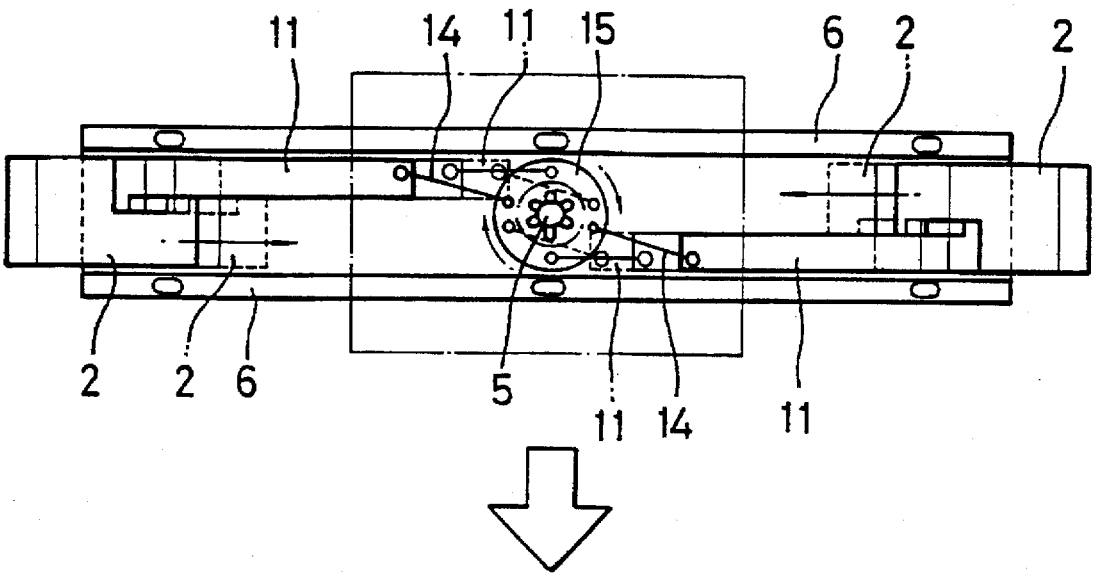
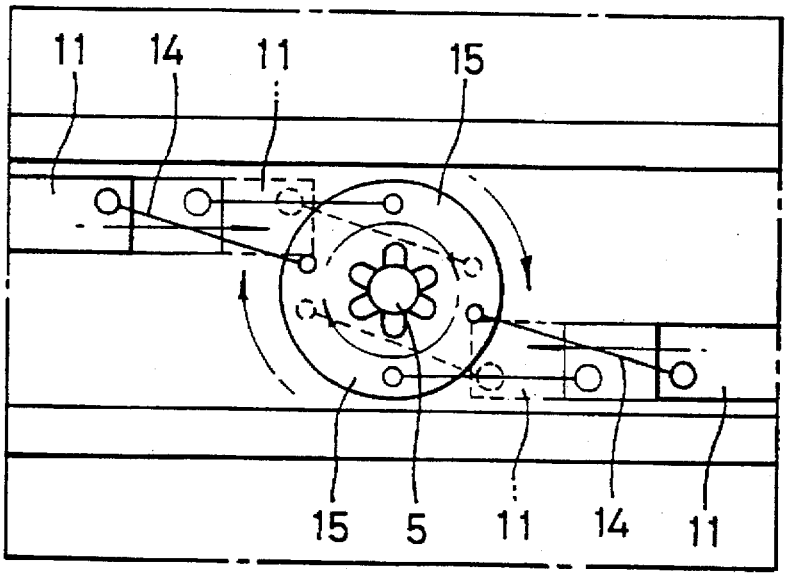
Fig. 9 (b)

LOCKING DEVICE FOR MANHOLE INNER COVERS

BACKGROUND OF THE INVENTION

1. Field of the Invention

The present invention relates, in general, to a locking device for manhole inner covers used for exclusively allowing authorized personnel to enter into the manholes and reach underground arrangements, such as pipes, drains or wires which need to be examined or repaired, inside the manholes and thereby protecting the arrangements and, more particularly, to a structural improvement in such a locking device for giving a specifically-designed structure, which is opened only by an authorized key, to the locking device thus more reliably protecting the underground arrangements inside the manholes.

2. Description of the Prior Art

As well known to those skilled in the art, manholes are covered openings which authorized personnel can enter in order to array underground arrangements, such as pipes, drains or wires (telephone wires, telegraph wires or electric wires) or to reach the arrangements which need to be examined or repaired. A typical manhole is covered by two manhole covers, that is, inner and outer covers. The covered manhole thus not only protects the underground arrangements from unauthorized persons, it also prevents pedestrians or vehicles from suddenly falling into the manhole. The manhole outer cover primarily covers the manhole on the ground and is almost completely leveled with the ground in order to be less likely to leave a step between the outer cover and the ground. The manhole inner cover is placed under the outer cover with a space between them thus secondarily covering the manhole and practically protecting the underground arrangements inside the manhole from unauthorized persons.

The manhole inner cover is provided with a locking device for locking the inner cover and exclusively allowing authorized personnel to enter into the manhole and reach the underground arrangements inside the manhole.

The typical locking devices for manhole inner covers have a rack and pinion construction. A locking device with the rack and pinion construction is unlocked by a simple key, which is inserted into the keyhole of the inner cover and is operated to linearly move the rack in a direction of opening the inner cover. In this regard, the above locking device may be easily unlocked by a sharpened tool, such as a screw driver or a gimlet, instead of the key. The typical locking device thus may fail to completely protect the underground arrangements from unauthorized persons who intent to reach the arrangements with the object of damaging or breaking the arrangements.

SUMMARY OF THE INVENTION

It is, therefore, an object of the present invention to provide a locking device for manhole inner covers in which the above problems can be overcome and which comprises structurally-improved elements operated only by an authorized key thus almost completely protecting the underground arrangements such as pipes, drains or wires from unauthorized persons intending to reach the arrangements with the object of damaging or breaking the arrangements.

In order to accomplish the above object, a locking device for a manhole inner cover in accordance with the present invention comprises a longitudinal channel type housing mounted to the manhole inner cover and provided with two springs, the springs being coupled to a channel bottom of the housing. A guide panel, which has a longitudinal guide slit, is mounted to each end portion of the housing so that a guide space is formed between the guide panel and the channel bottom of the housing. Two reciprocating units are arranged on the channel bottom of the housing so that the arrangement of the units inside the housing is point-symmetric about the center of the housing. Each reciprocating unit receives an associated spring of the housing and is thereby biased by the spring. Each unit includes a plurality of regularly-spaced gear holes, which are formed on one side surface of one end portion of the unit in one row and are adapted for selectively engaging with an asterisk part of a key in order to axially reciprocate the unit in the housing when locking or unlocking the device. A hook protrusion is provided on the other end portion of the unit. A locking bolt is coupled to each reciprocating unit and is movably received in the guide space under the guide panel so that the locking bolt linearly reciprocates by a reciprocating motion of the unit under the guide of the guide slit of the guide panel thus fully projecting or retracting from or into the housing. The locking bolt has a notch movably engaging with the hook protrusion of each reciprocating unit. A central member is mounted to the center of the housing at a position above the reciprocating units. The central member has a guide notch, a central key passing hole and stop means. The stop means selectively stops a reciprocation of the units when at least one of the units diverges from its linear reciprocating passage. A keyhole panel is movably seated on the central member so that the keyhole panel can move in a vertical direction under the guide of the guide notch of the central member. The keyhole panel has a keyhole and a guide protrusion. The keyhole has an asterisk configuration corresponding to the asterisk part of the key, while the guide protrusion is movably received in the guide notch of the central member.

BRIEF DESCRIPTION OF THE DRAWINGS

The above and other objects, features and other advantages of the present invention will be more clearly understood from the following detailed description taken in conjunction with the accompanying drawings, in which:

FIG. 5(*b*) is an enlarged view of a portion shown in FIG. 5(*a*);

FIG. 9(*a*) is a view showing the operation of a locking device, which has a rotating disc connected to the reciprocating units by means of respective connection links in accordance with a further embodiment of the present invention; and FIG. 9(*b*) is an enlarged view of a portion shown in FIG. 9(*a*);

FIG. 10(*b*) is an enlarged view of a portion shown in FIG. 10(*a*).

DESCRIPTION OF THE PREFERRED EMBODIMENTS

Figure 1:
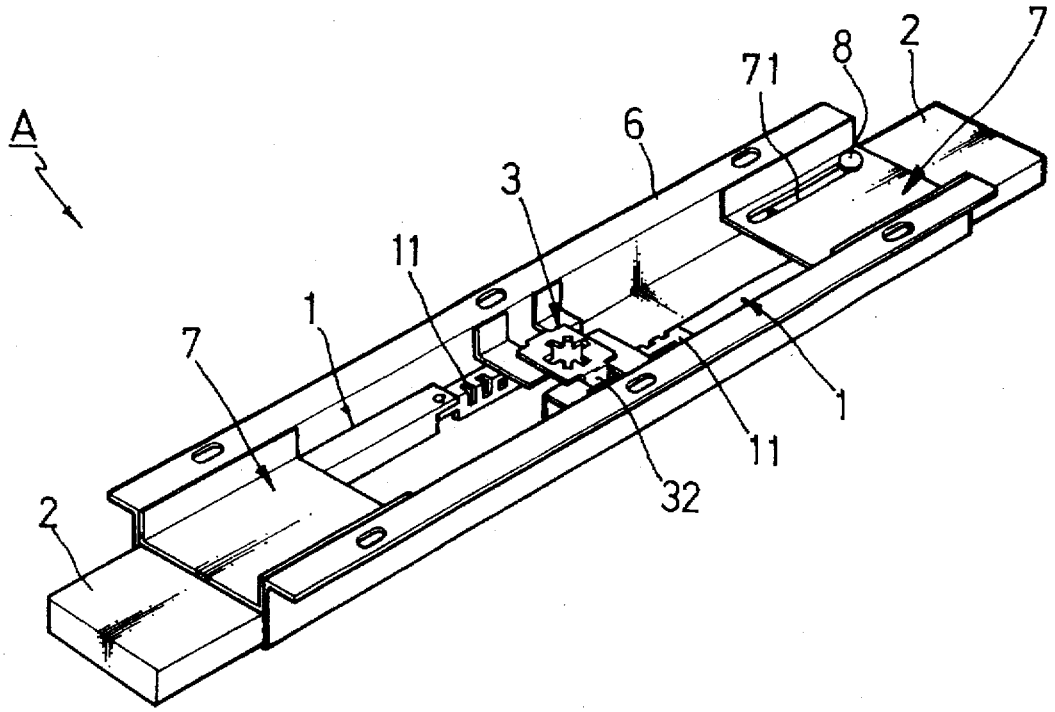
FIG. 1 is a perspective view showing the point-symmetric construction of a locking device for manhole inner covers in accordance with the primary embodiment of the present invention.
Figure 2:
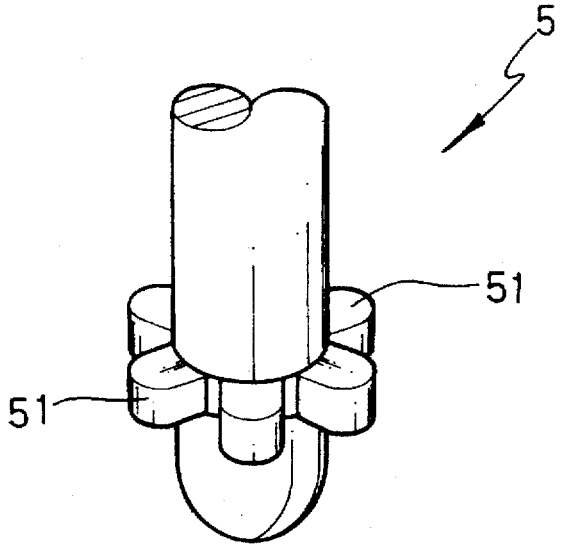
FIG. 2 is a perspective view of an asterisk key used for locking or unlocking the locking device of FIG. 1.
Figure 3:
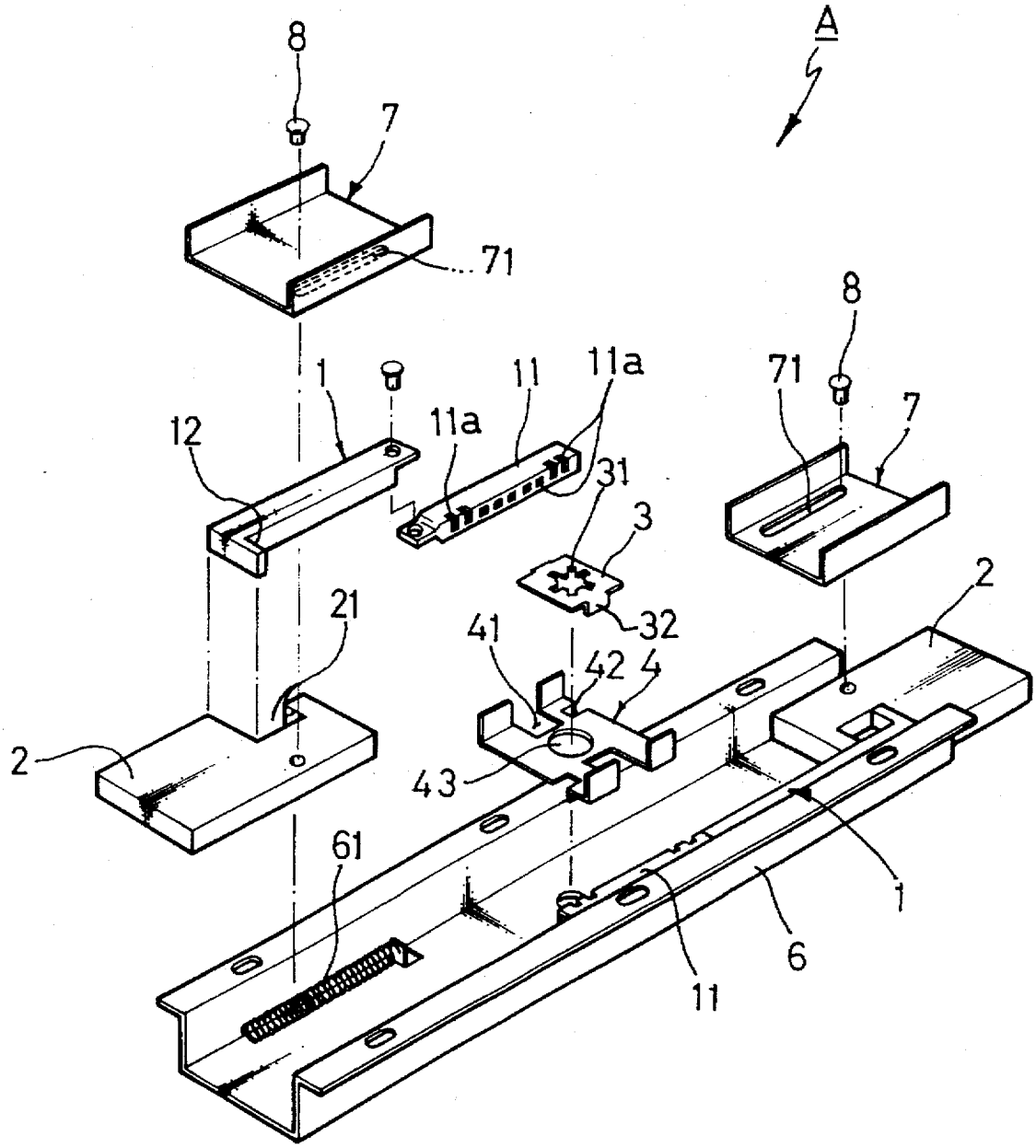
FIG. 3 is an exploded perspective view of the locking device of FIG. 1.
Figure 7:
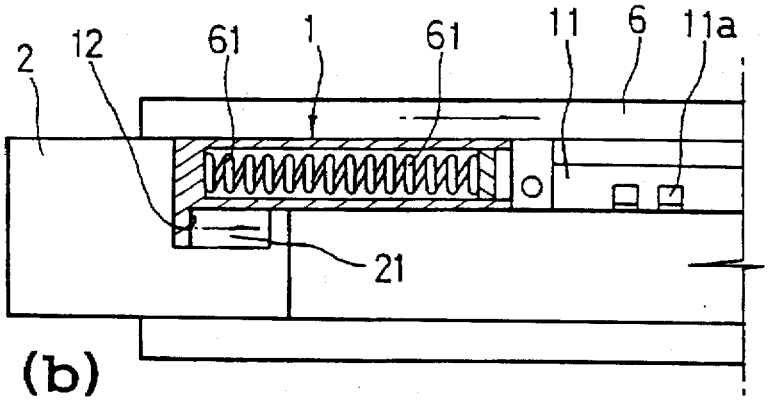
FIGS. 7*a* and 7*b* are partially sectioned plan views showing the movement of a reciprocating unit engaging with a locking bolt of the above locking device.
Figure 7:
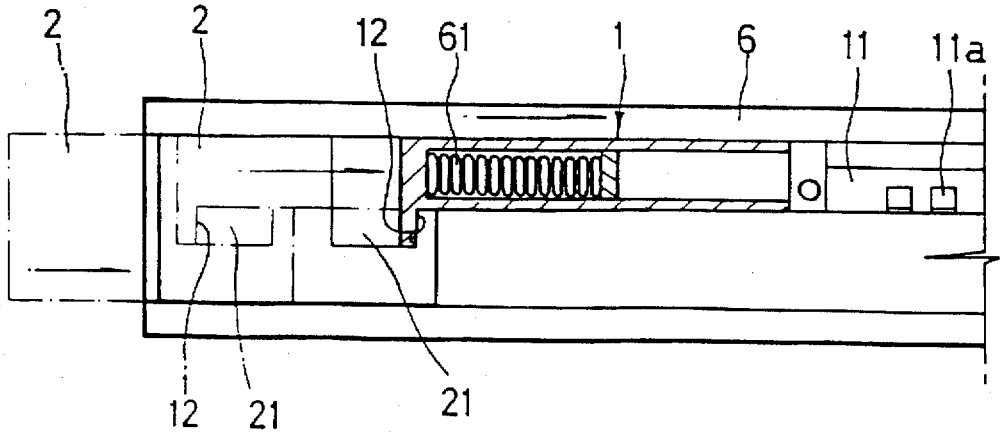

The locking device "A" for manhole inner covers according to the present invention is provided on the bottom side of a manhole inner cover "C" placed inside a manhole M. The locking device "A" includes two reciprocating units 1, which are axially arranged on both end portions of a channel type housing 6 so that the arrangement of the units 1 inside the housing 6 is point-symmetric about the center of the housing 6. As shown in FIGS. 1 and 3, each reciprocating unit 1 according to the primary embodiment of the invention comprises two longitudinal parts, that is, a rack part 11 and a hook part 12 which are hinged together. The above rack part 11 is provided with a plurality of regularly-spaced gear holes 11*a* on one side surface thereof. Meanwhile, the hook part 12 is hinged to the rack part 11 on one end thereof and has a hook protrusion on the other end thereof. The above holes 11*a* of the rack part 11 engage with the asterisk part 51 of a key 5 as will be described later herein. Two springs, for example, compression coil springs 61 are coupled to the channel bottom of the housing 6 and are axially arranged on the housing 6. The above springs 61 are received in the respective units 1 thus biasing the units 1 outward. In the primary embodiment, each spring 61 is received in the hook part 12 of each unit 1 as shown in FIGS. 7*a* and 7*b*. The locking device also includes two locking bolts 2 of the panel type. The above locking bolts 2 are coupled to the respective reciprocating units 1 and are movably arranged on both ends of the longitudinal housing 6. Each locking bolt 2 has a notch 21, which movably engages with the hook protrusion of each unit 1. A guide panel 7 with a longitudinal guide slit 71 is mounted to each end of the housing 6 so that a guide space is defined between the panel 7 and the channel bottom of the housing 6. Each locking bolt 2 is movably received in the above space between the panel 7 and the housing 6. A guide bolt 8 is screwed to each locking bolt 2 after passing through the guide slit 71 of the guide panel 7 so that the locking bolt 2 can axially and linearly reciprocate in the housing 6 under the guide of the guide slit 71 if the guide panel 7 thus fully projecting or retracting from or into the housing 6. The above locking device further includes a central member 4. The above central member 4, which is mounted to the center of the housing 6 at a position spaced above the reciprocating units 1, has two guide notches 41 and two vertical stoppers 42. Each vertical stopper 42 is directed downward. The center of the above member 4 is holed to form a key passing hole 43. Movably seated on the above central member 4 is a keyhole panel 3 having a generally-rectangular shape. Two guide protrusions 32 vertically extend downward from opposite edges of the keyhole panel 3, while an asterisk keyhole 31 is formed on the center of the panel 3. The keyhole panel 3 is seated on the central member 4 by receiving the protrusions 32 into the respective notches 41 of the central member 4 so that the keyhole panel 3 can move in a vertical direction under the guide of the notches 41. The above locking device is locked or unlocked by the specifically-designed key 5. As shown in FIG. 2, the lower portion of the above key 5 has the asterisk part 51, whose configuration is corresponding to the keyhole 31 of the keyhole panel 3.

In the drawings, the reference character "B" denotes the outer manhole cover.

Figure 8:
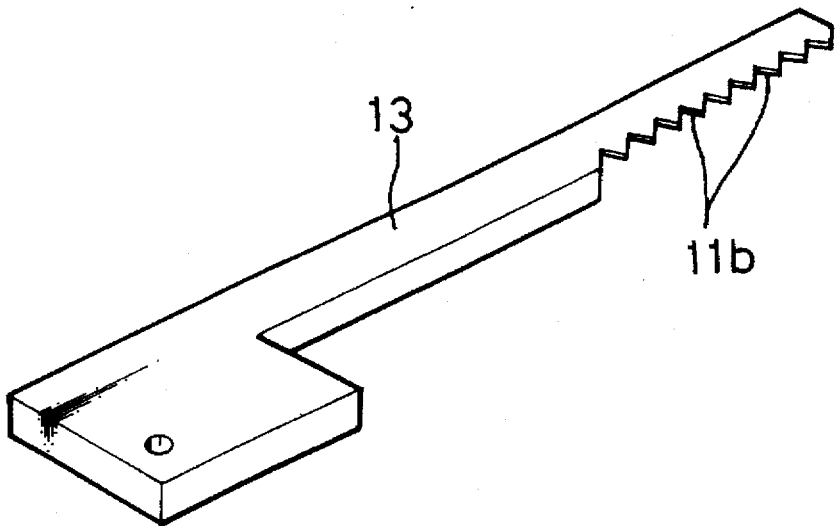
FIGS. 8*a* and 8*b* are perspective views, each showing the construction of a locking bolt and reciprocating unit in accordance with another embodiment of the present invention.
Figure 8:
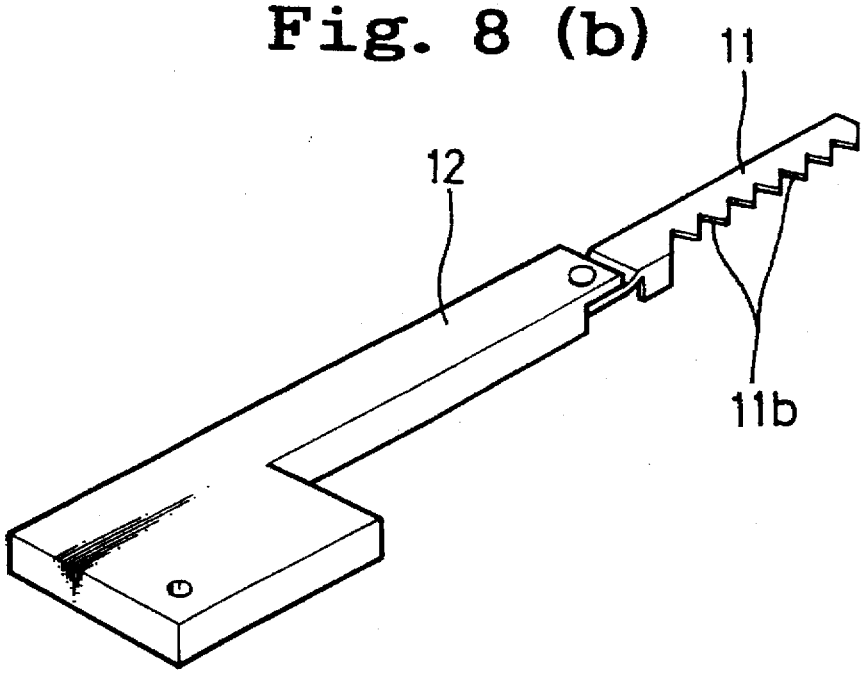

In accordance with another embodiment of the present invention, the reciprocating unit 1 and locking bolt 2 may be altered as follows. That is, the rack and hook parts of the unit i and the locking bolt may be cast into a rack-operated locking member 13 of a single structure as shown in FIG. 8*a*. In this embodiment, one end portion of the locking member 13 is provided with a plurality of teeth 11*b* instead of the above-described holes 11*a*, thus forming a rack part. Meanwhile, the other end portion of the locking member 13 is shaped into a locking bolt part of the panel type. Alternatively, the locking bolt and the hook part of the unit 1 may be cast into a single structure, while the rack part 11 of the unit 1 may be separately formed as shown in FIG. 8*b*. In this embodiment, the rack part 11 is provided with a plurality of teeth 11*b* instead of the above-described holes 11*a* and is hinged to the locking bolt-integrated hook part 12. In each of the above embodiments of FIGS. 8*a* and 8*b*, the asterisk part 51 of the key 5 engages with the teeth 11*b* of the rack part so that the reciprocating unit 1 can linearly reciprocate in accordance with a rotating motion of the key 5. The locking bolt part thus fully projects or retracts from or into the housing in order to lock or unlock the locking device "A" of the manhole inner cover "C".

FIG. 9 shows the operation of a locking device according to a still another embodiment of this invention. In the locking device of FIG. 9, the rack part 11 of each reciprocating unit is free from the holes 11*a*, but is connected to a rotating disc 15 by means of a connection link 14. The asterisk keyhole is formed on the center of the disc 15. The rotating disc 15 is arranged on the center of the housing 6. The above disc 15 is rotated by the key 5, which has the asterisk part 51 of a configuration corresponding to the asterisk keyhole of the disc 15. The rack parts 11 engaging with the locking bolts 2 axially and linearly reciprocate in the housing by a rotating motion of the disc 15 thus locking or unlocking the locking device "A" of the manhole inner cover "C".

The operational effect of the above locking device "A" will be described hereinbelow.

Figure 4:
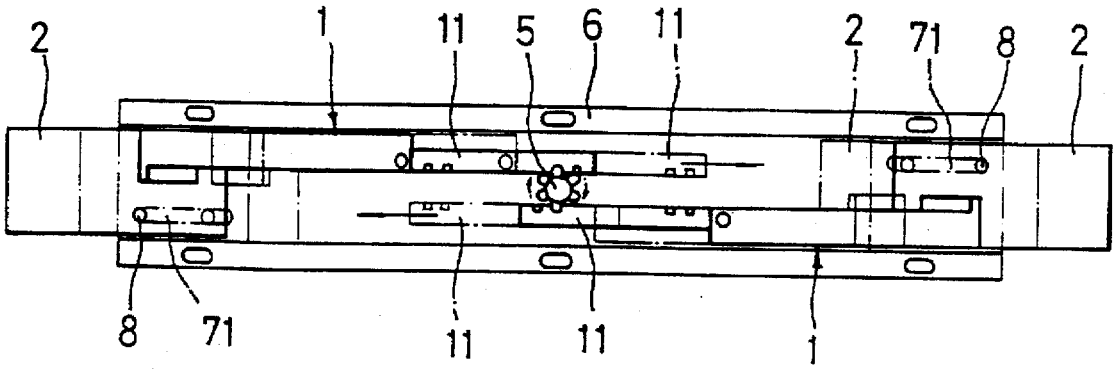
FIG. 4 is a plan view of the above locking device and shows the operation of the device when unlocking a manhole inner cover.
Figure 5A:
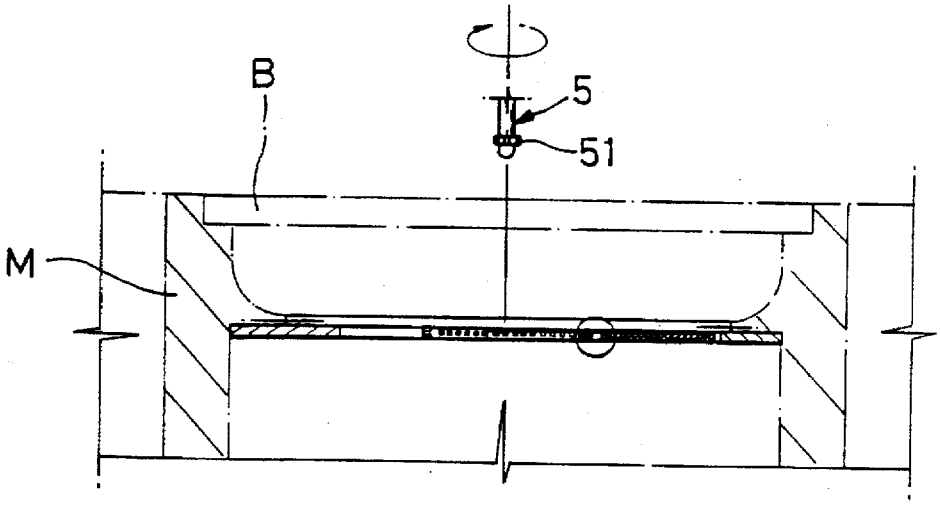
FIG. 5(*a*) is a front view of a manhole inner cover equipped with the locking device of FIG. 1.
Figure 5B:
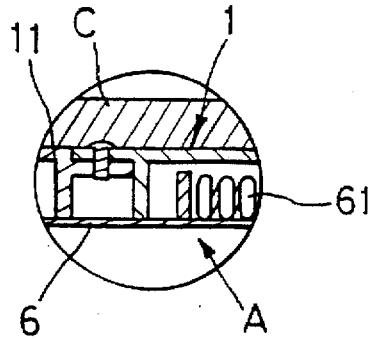

The locking device "A" of this invention is mounted to the bottom side of the inner cover "C" by mounting the housing 6 to the cover "C" as shown in FIG. 5. In order to operate the above locking device "A", the key 5 is inserted into the keyhole (not shown) of the manhole inner cover "C" so that the asterisk part 51 of the key 5 passes through the asterisk keyhole 31 of the keyhole panel 3 and in turn passes through the key passing hole 43 of the central member 4. The teeth of the asterisk part 51 in the above state engage with the gear holes 11*a* of the rack parts 11 as shown in FIG. 4. The locking device "A" in the above state can be thus locked or unlocked by the key 5.

Figure 6:
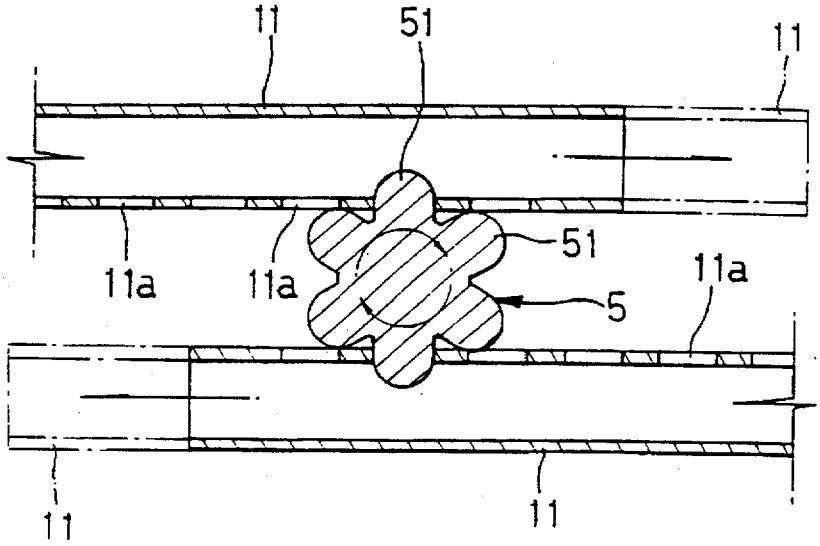
FIG. 6 is a plan view showing the operation of two reciprocating units of the locking device of FIG. 1, the reciprocating units engaging with the asterisk key of FIG. 2 and linearly moving in accordance with a rotating motion of the key.

In order to unlock the locking device "A" and open the manhole inner cover "C", the key 5 in the above state is rotated clockwise as shown in FIGS. 4 and 6. When the key 5 is rotated clockwise, the rack parts 11 of the reciprocating units 1 engaging with the asterisk part 51 of the key 5 linearly move in opposite directions as shown by the arrows of FIGS. 4 and 6. Due to such a movement of the rack parts 11, the reciprocating units 1 move toward the center of the housing 6 while compressing the respective compression coil springs 61 as shown in FIGS. *7a* and *7b*. The hook protrusion of each hook part 12 in the above state primarily moves inside the notch 21 of each locking bolt 2 until the hook protrusion is stopped by the inside edge of the notch 21 as shown by the arrow of FIG. *7a*. The hook protrusion in turn pulls the locking bolt 2 toward the center of the housing 6 as shown by the arrow of FIG. *7b*. The locking bolt 2 is thus fully retracted into the housing 6 under the guide of the longitudinal guide slit 71 of the guide panel 7. The locking device "A" is thus brought into the unlocked state so that the manhole inner cover "C" can be opened.

When the rotating force is removed from the key 5 after opening the inner cover "C", the reciprocating units 1 elastically return to their original positions due to the restoring force of the compression coil springs 61 so that the locking bolts 2 fully project from the housing 6.

In order to lock the manhole inner cover "C", the locking bolts 2 are fully retracted into the housing 6 by operating the reciprocating units 1 in the same manner as described for the case of unlocking the cover "C". The manhole inner cover "C" in the above state is positioned on its place inside the manhole "M" prior to removing the key 5 from the locking device "A" of the cover "C". When the key 5 is removed from the locking device "A", the reciprocating units 1 elastically return to their original positions due to the restoring force of the compression coil springs 61. That is, the locking bolts 2 fully project from the housing 6 thus tightly locking the inner cover "C".

The locking device "A" of this invention is provided with various safety members which successfully prevent unauthorized persons, who intent to reach the underground arrangements inside the manhole "M" with the object of damaging or breaking the arrangements, from unlocking the inner cover "C" and entering into the manhole "M". One of the above safety members is provided in the keyhole panel 3, which has a size of being smaller than the width of the channel type housing 6. The above keyhole panel 3 is movably seated on the central member 4 by receiving the protrusions 32 of the panel 3 into the respective guide notches 41 of the member 4 so that the panel 3 can move in a vertical direction. In this regard, the position of the keyhole panel 3 is changeable relative to the central member 4 so that the asterisk keyhole 31 of the panel 3 may be not aligned with both the keyhole of the cover "C" and the key passing hole 43 of the central member 4. Therefore, the keyhole panel 3 gives an unauthorized person trouble while seeking for the asterisk keyhole 31, thus causing the person to abandon one's intention. Even when an unauthorized person, who succeeds in seeking for the asterisk keyhole 31, tries to operate the rack parts 11 of the reciprocating units 1 with the sharpened tip of a tool instead of the asterisk key 5, the person is less likely to fully move the rack parts 11 due to the construction of the parts 11. The regularly-spaced holes 11*a* of each rack part 11 comprise two types of holes, that is, two pairs of end holes, each pair of which is provided on each end portion of the part 11 and has a slit configuration extending from the top to the side wall of the part 11, and a plurality of middle holes, which are formed on the side wall of the part 11 in one row between the above end holes. Due to the configuration of the above holes 11*a*, a tool with the sharpened tip fails to fully operate the rack parts 11 so that it cannot unlock the manhole inner cover "C" equipped with the locking device "A".

Figure 10:
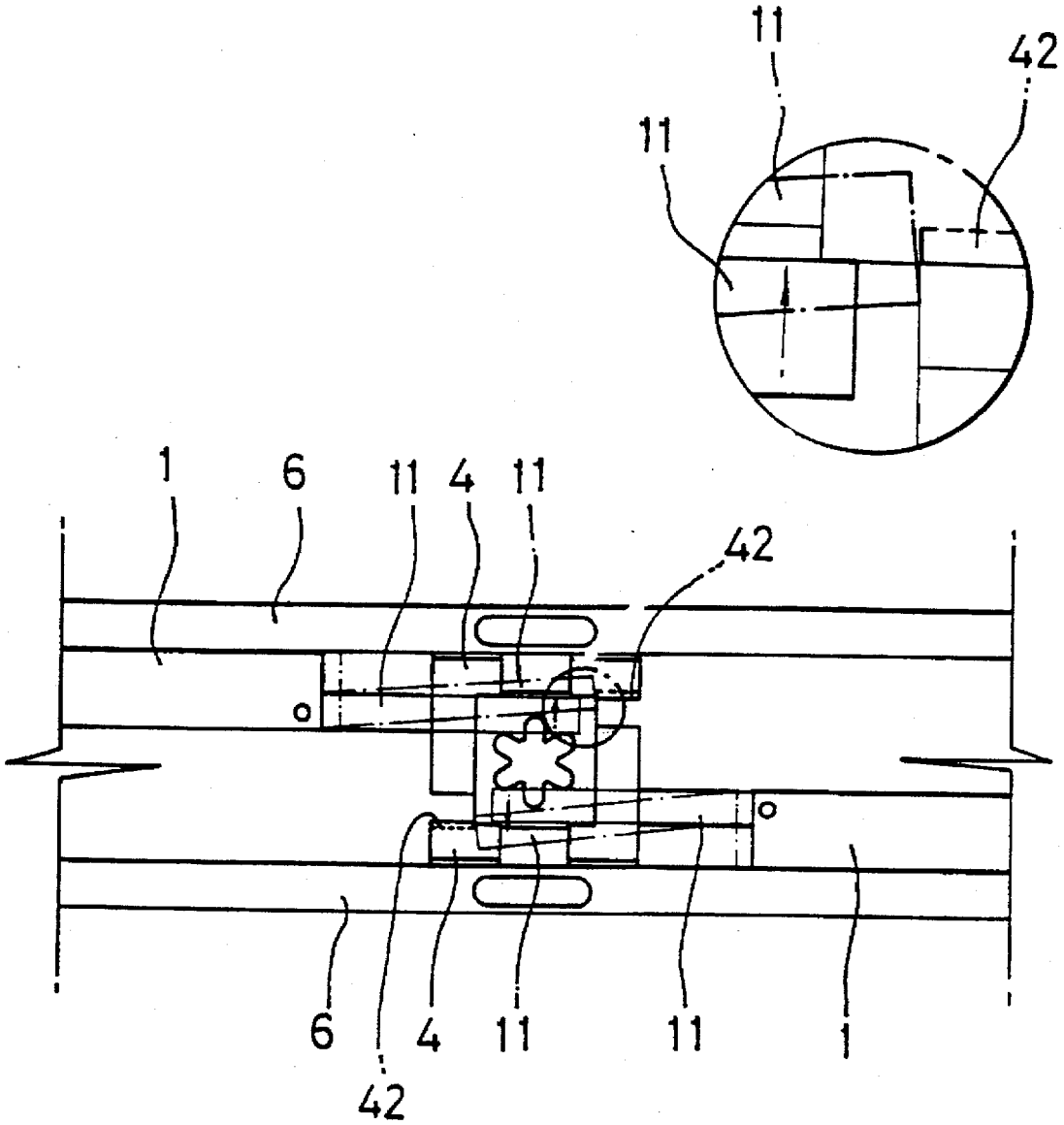
FIG. 10(*a*) is a view showing the reciprocating units, which are stopped by a stop means of a central member and are prevented from moving when an unauthorized person operates the locking device with a sharpened tool instead of the asterisk key in order to unlock the locking device.

Another one safety member is provided in the central member 4. That is, when the hinged rack part 11 even slightly diverges from its linear reciprocating passage while the part 11 is operated by an unauthorized person, the inside end of the part 11 is stopped by the stopper 42 of the central member 4 as shown in FIG. 10. The rack part 11 in the above state cannot move any more so that the locking bolt 2 cannot be retracted into the housing 6. The manhole inner cover "C" in the above state cannot be thus unlocked.

The last safety member is provided in the engagement between the reciprocating unit 1 and the locking bolt 2. That is, the width of the notch 21 of each locking bolt 2 is substantially wide enough to allow the hook protrusion of the hook part 12 to move in a distance within the notch 21 until the hook protrusion is stopped by the inside edge of the notch 21. Due to such an engagement between the hook protrusion and the notch 21, there is an interval between the time the reciprocating unit 1 starts to move and the time the locking bolt 2 starts to move. That is, the moving distance of the unit 1 is longer than that of the locking bolt 2 by the moving distance of the hook protrusion inside the notch 21. The locking device "C" of this invention is thus less likely to be unlocked by unauthorized persons, who intent to reach the underground arrangements inside the manhole "M" with the object of damaging or breaking the arrangements.

As described above, the present invention provides a structurally-improved locking device for manhole inner covers. The above locking device is locked or unlocked only by an authorized key having an asterisk configuration as the device is provided with a reciprocating unit and a locking bolt, which are specifically designed to be operated only by the authorized key. The locking device thus almost completely protects the underground arrangements such as pipes, drains or wires from unauthorized persons, who intend to reach the arrangements with the object of damaging or breaking the arrangements.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A locking device for a manhole inner cover comprising:

a channel type housing mounted to said manhole inner cover and provided with two springs on a channel bottom thereof;

a guide panel provided with a longitudinal guide slit and mounted to each end of said housing so that a guide space is formed between said guide panel and the channel bottom of the housing;

two reciprocating units arranged in the housing so that the arrangement of the units inside the housing is point symmetric about the center of the housing, each reciprocating unit receiving each spring of the housing and being thereby biased by the spring and including:

a plurality of regularly-spaced gear holes formed on one end portion of the unit in one row and adapted for selectively engaging with an asterisk part of a key in order to axially reciprocate the unit in the housing when locking or unlocking the device; and a hook protrusion provided on the other end portion of said unit;

a locking bolt coupled to each reciprocating unit and movably received in the guide space under the guide panel so that the locking bolt linearly reciprocate under the guide of said guide slit of the guide panel thus fully projecting or retracting from or into the housing when reach unit reciprocates, said locking bolt having a notch movably engaging with the hook protrusion of each reciprocating unit;

a central member mounted to the center of said housing at a position above the reciprocating units, said central member having a guide notch, a central key passing hole and stop means, said stop means selectively stopping a reciprocation of the units when at least one of the units diverges from its linear reciprocating passage; and a keyhole panel movably seated on said central member so that the keyhole panel can move in a vertical direction under the guide of said guide notch of the central member, said keyhole panel having a keyhole and a guide protrusion, said keyhole having an asterisk configuration corresponding to the asterisk part of the key, and said guide protrusion being movably received in said guide notch of the central member.

* * * * *